US005860713A

United States Patent [19]

Richardson

[11] Patent Number: 5,860,713

[45] Date of Patent: Jan. 19, 1999

[54] WIRE MANAGEMENT ARRANGEMENT

[75] Inventor: Earl Richardson, Tyler, Tex.

[73] Assignee: Anderson Hickey Company, Henderson, Tex.

[21] Appl. No.: 869,230

[22] Filed: Jun. 4, 1997

[51] Int. Cl.[6] ..... A47B 35/00; A47B 77/08; A47B 13/00

[52] U.S. Cl. ..... 312/223.6; 312/194; 108/64; 16/260; 174/48

[58] Field of Search ..... 312/223.6, 223.5, 312/223.4, 194; 108/50.01, 50.02, 64; 16/260; 174/48, 50, 65 G, 66, 67

[56] References Cited

U.S. PATENT DOCUMENTS

| | | | |
|---|---|---|---|
| D. 296,761 | 7/1988 | Mockett . | |
| D. 301,433 | 6/1989 | Krauss . | |
| D. 317,559 | 6/1991 | Simonton . | |
| D. 355,110 | 2/1995 | Olson et al. . | |
| 945,753 | 1/1910 | Chamberlain et al. . | |
| 1,786,823 | 12/1930 | Carrington et al. . | |
| 3,783,175 | 1/1974 | Timmons . | |
| 3,873,758 | 3/1975 | VanGessel et al. . | |
| 3,883,202 | 5/1975 | Konig . | |
| 4,053,701 | 10/1977 | Ogilvie et al. . | |
| 4,094,256 | 6/1978 | Holper et al. . | |
| 4,163,867 | 8/1979 | Breidenbach . | |
| 4,296,981 | 10/1981 | Hildebrandt et al. . | |
| 4,323,291 | 4/1982 | Ball . | |
| 4,372,629 | 2/1983 | Propst et al. . | |
| 4,422,385 | 12/1983 | Rutsche et al. . | |
| 4,654,756 | 3/1987 | Wilson et al. . | |
| 4,721,476 | 1/1988 | Zeliff et al. . | |
| 4,730,363 | 3/1988 | Asbaghi . | |
| 4,734,826 | 3/1988 | Wilson et al. . | |
| 4,792,881 | 12/1988 | Wilson et al. . | |
| 4,840,514 | 6/1989 | Defrance et al. | 16/260 X |
| 4,864,078 | 9/1989 | Bowman . | |
| 4,884,513 | 12/1989 | Newhouse et al. . | |
| 4,948,205 | 8/1990 | Kelley . | |
| 4,984,982 | 1/1991 | Brownlie et al. | 174/48 X |
| 5,008,975 | 4/1991 | Wang et al. | 16/260 X |
| 5,050,267 | 9/1991 | Quest . | |
| 5,083,512 | 1/1992 | Newhouse et al. . | |
| 5,103,741 | 4/1992 | Grund et al. | 312/223.6 X |
| 5,121,698 | 6/1992 | Kelley . | |
| 5,130,494 | 7/1992 | Simonton et al. . | |
| 5,154,126 | 10/1992 | Newhouse et al. . | |
| 5,167,047 | 12/1992 | Plumley . | |
| 5,230,552 | 7/1993 | Schipper et al. . | |
| 5,231,562 | 7/1993 | Pierce et al. . | |
| 5,237,935 | 8/1993 | Newhouse et al. . | |
| 5,272,988 | 12/1993 | Kelley et al. . | |
| 5,427,265 | 6/1995 | Cautereels et al. | 16/260 X |
| 5,429,431 | 7/1995 | Olson et al. . | |

FOREIGN PATENT DOCUMENTS

| | | | |
|---|---|---|---|
| 2535914 | 5/1984 | France | 174/48 |
| 406098446 | 4/1994 | Japan | 174/48 |
| 2130877 | 6/1984 | United Kingdom . | |
| 2279002 | 12/1994 | United Kingdom | 312/223.6 |

*Primary Examiner*—Peter M. Cuomo
*Assistant Examiner*—Hanh V. Tran
*Attorney, Agent, or Firm*—Flynn, Thiel, Boutell & Tanis, P.C.

[57] ABSTRACT

A wire management arrangement is provided in a work surface arrangement to route cabling through the work surfaces. The wire management system includes two end grommet assemblies at the opposite ends of each work surface which permit the horizontal and vertical passage of cabling therethrough, and secondary grommets which permit the passage of cabling vertically therethrough. Each of the end grommet assemblies includes a housing that defines a vertical passage which extends through the work surface and a horizontal passage which is in communication with the vertical passage and extends through an end edge of the work surface so as to open into an adjacent work surface. A top cover and end cover are pivotally connected to the housing to respectively cover the vertical and horizontal passages.

27 Claims, 8 Drawing Sheets

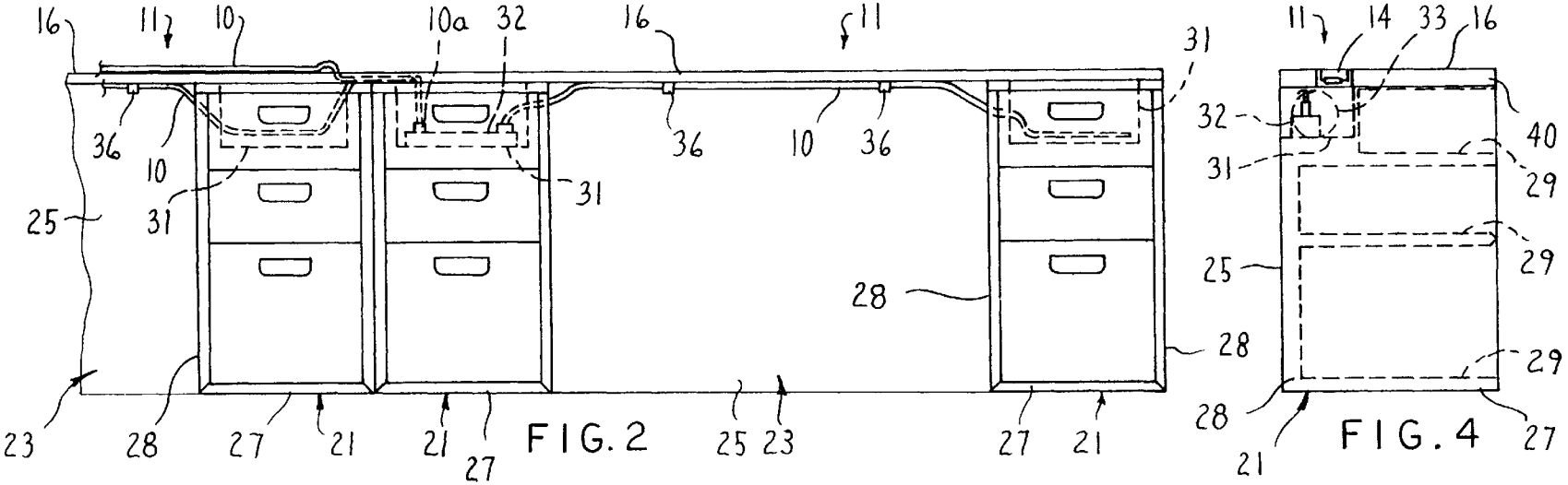
FIG. 2
FIG. 4
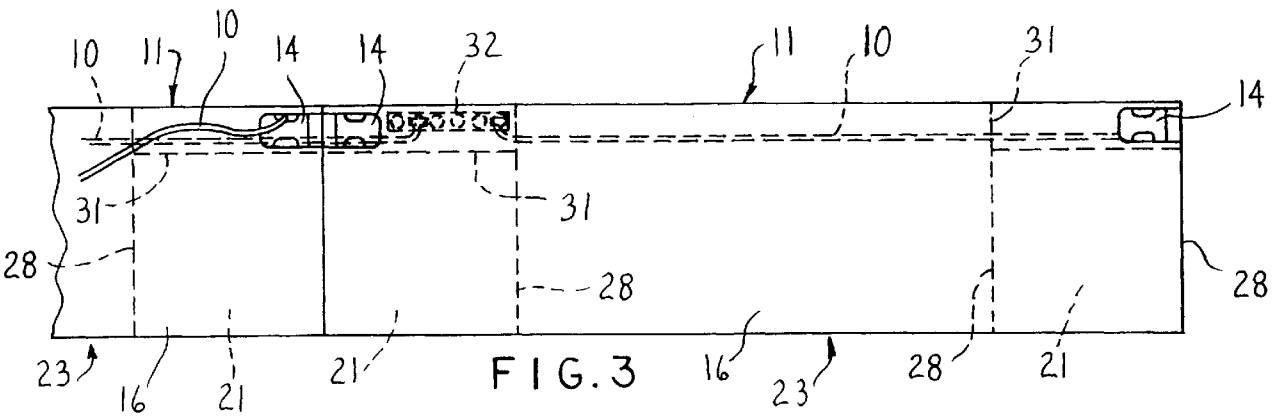
FIG. 3

WIRE MANAGEMENT ARRANGEMENT

FIELD OF THE INVENTION

The invention relates to a wire management arrangement for office furniture, and more particularly relates to a grommet arrangement for routing cabling through a desk or the like.

BACKGROUND OF THE INVENTION

Commonly, open office areas are divided into individual workstations by space-dividing upright wall panels, desk arrangements or combinations thereof. To accommodate office equipment such as computers, telephones and the like in these workstation areas, electrical and telecommunications cabling is laid throughout the office area to the individual workstations. The cabling is then connected to the office equipment which typically is supported on a work surface that is spaced above the floor. The work surface may be part of the desk or supported from the wall panels.

When providing cabling to the workstations, it is known to route the cabling through the furniture components such as longitudinally between serially-connected wall panels or from one desk to an adjacent desk. Often the cabling is routed throughout the office near floor level or worksurface level such as through raceways formed along the wall panels which hide and protect the cabling. Also, it is known to route the cabling underneath a floor while conventional electrical and telecommunications outlets are provided in the floor itself. However, since office equipment can be and often is supported both above and below the worksurfaces, grommets have been used to route cabling between floor level and the top of the work surface through passages formed in the work surface.

Accordingly, numerous grommets have been provided which define openings in work surfaces through which cabling passes. It is also known to provide grommets in a vertical wall of the furniture component such as a side wall of a desk for the passage of cabling horizontally therethrough.

Grommets typically include a ring-like housing which seats within an opening formed in the horizontal work surface or the vertical wall and defines a relatively large open passage therethrough. Grommets also include caps or covers which seat within the housing to enclose most of the unused area of the opening, and have notches or cut-outs through which the cabling passes.

While many grommets mount in the horizontal work surface, grommets in adjacent end walls of two adjacent desks can be provided directly next to each other to allow the passage of cabling therebetween. It is also known to provide a grommet which allows for the passage of cabling both vertically through the work surface and horizontally through the side wall.

Examples of grommet arrangements having vertical and horizontal passages are disclosed in U.S. Pat. Nos. 4,323,291, 4,884,513, 5,130,494 and 5,429,431, as well as U.K. Patent Application GB 2 130 877.

However, a need is believed to exist for an improved grommet assembly which readily accommodates cabling passing horizontally and vertically therethrough.

Accordingly, the inventive wire management arrangement includes end grommet assemblies which are mountable to the opposite ends of a furniture component such as a desk. The work surface of the desk is formed with openings cut out from the opposite edges thereof which receive the end grommet assemblies therein.

The end grommet includes a housing that defines a hollow interior which opens vertically to define a vertical passage. The housing, however, is open at the edge of the work surface to define a horizontal passage therethrough which is in communication with the vertical passage. Cabling can be passed vertically through the grommet housing and also horizontally out of the open end thereof. When the open ends of two grommet assemblies are positioned adjacent to each other such as when two desks are joined together, a continuous horizontal passage is provided therebetween.

While the vertical and horizontal passages formed by the grommet housing are relatively large to provide for the ready placement of cabling therein, most of this open area is enclosed by openable covers. Accordingly, the end grommet assembly includes a pivotable top cap which generally covers the vertical passage, and a pivotable end cap which generally covers the horizontal passage. The top and end caps can be pivoted upwardly to lay cabling therethrough and also can be closed once laying of the cabling is completed. The top cap includes a pair of notches or openings which allow for the passage of cabling vertically therethrough when the top cap is closed. The end cap also includes at least one notch or opening which opens horizontally to allow for the horizontal passage of cabling.

Thus, the grommet assembly only requires three component parts, namely the top cap, end cap and grommet housing. While the top and end caps are pivotally secured to the grommet housing, the top and end caps also are readily removable by a user to further ease the laying of the cabling. In particular, when the end and top caps are pivoted to substantially vertical open positions, the end and top caps can be slid into and out of engagement with the grommet housing. However, when the end and top caps are in the respective closed positions, removal of these top and end caps is prevented.

If additional vertical passages are required in a desk arrangement, secondary grommet assemblies can also be provided which each define a vertical passage and include a pivotable top cap.

Other objects and purposes of the invention, and variations thereof, will be apparent upon reading the following specification and inspecting the accompanying drawings.

BRIEF DESCRIPTION OF THE DRAWINGS

FIG. 2 is a partial front elevational view of the desk arrangement of FIG. 1.

FIG. 3 is a partial top plan view of the desk arrangement.

FIG. 4 is a side elevational view of one of the desks.

Figure 1:
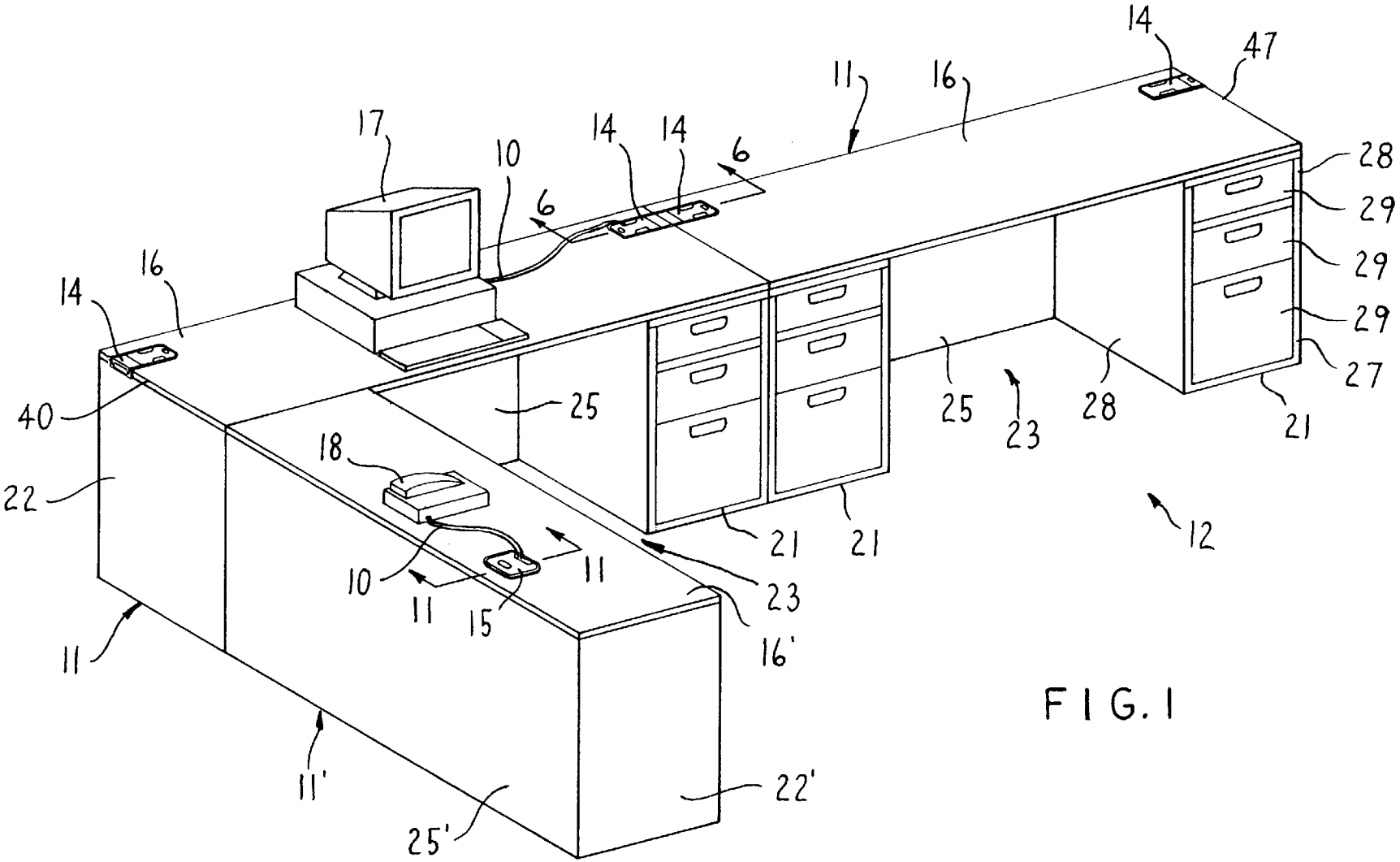
FIG. 1 is an isometric view illustrating a plurality of desks which include a wire management arrangement of the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1 and 2, the invention relates to a wire management arrangement for the routing of electrical and telecommunications cabling 10 through furniture components such as desks 11. The wire management arrangement includes a plurality of end grommets 14 located at the opposite ends of the desks 11, and one or more secondary grommets 15. The grommets 14 and 15 permit the passage of cabling vertically and horizontally through the desks 11.

Generally, relatively large office areas are subdivided into individual workstation areas 12 by space-dividing furniture components, such as the desks 11. While the desks 11 may be used by themselves to define the workstation areas 12, other furniture components such as space-dividing upright wall panels (not illustrated) may also be used to provide additional privacy. An example of such a wall panel system is disclosed in U.S. Pat. No. 5,377,466, the disclosure of which is incorporated herein in its entirety by reference.

In a typical office area, each individual workstation area 12 preferably is provided with a horizontally enlarged work surface 16 such as the work surface 16 of the desk 11. Alternatively, if only wall panels (not illustrated) are provided, the work surfaces typically are supported by the wall panels themselves. The work surface 16 not only provides an area for the user to work but also supports office equipment thereon such as a computer 17 or a telephone 18. Additional office equipment may also be supported on a floor.

As a result, each workstation area 12 typically requires both electrical and telecommunications connections for the office equipment which connections are provided by the cabling 10.

To supply the power and telecommunications cabling 10 to the desks 11, the cabling 10 is laid throughout the office area using conventional techniques. For example, when wall panels (not illustrated) are provided with the desks 11, these wall panels typically include horizontal raceways or channels extending longitudinally along the length thereof through which the cabling 10 is laid. The cabling 10 thereby exits the wall panels at each individual workstation 12 often near floor level, although it is also known to lay the cabling in the wall panels at work surface level. It is further known to lay wires below the floors and provide electrical outlets (not illustrated) in the floor into which the office equipment can be plugged using conventional three-prong plugs.

However, since the cabling 10 may be provided at or near floor level while the office equipment is located at work surface level or vice versa, it often is necessary to further route the cabling 10 vertically through the work surface 16 of the desk 11 to provide power and telecommunications signals to the office equipment. Also, it may be necessary or desirable to route the cabling 10 horizontally between two adjacent work surfaces 16.

To thereby permit the routing of cabling 10 through the work surfaces 16, the wire management system of the invention preferably includes two of the end grommet assemblies 14 in each work surface 16 as discussed in detail hereinafter.

Generally with respect to the furniture arrangement illustrated in FIGS. 1–3 to which the end grommet assemblies 14 are mounted, two of the desks 11 are positioned adjacent to each other to define the workstation area 12. The left desk 11 includes a return desk 11' at one end thereof. Typically, the return desk 11' is joined to the desk 11 as a single L-shaped unit. This arrangement of desks 11 is provided for illustrative purposes although the wire management arrangement is usable with other arrangements of desks or furniture.

The opposite ends of the desks 11 include upstanding pedestals 21 and/or end walls 22 which are supported on a floor. The pedestals 21 and end walls 22 at the opposite ends of the work surface 16 are spaced laterally apart in each desk 11 so as to define open areas or knee spaces 23 therebetween for accommodating the legs of a user. The pedestals 21 and end walls 22 support the horizontal work surfaces 16 on the top thereof, while the computer 17 and telephone 18 are supported on these work surfaces 16. The desks 11 and 11' also include back walls 25 which extend along the length thereof to separate the open area 23 from one side of the desks 11 or 11' for privacy.

More particularly with respect to the pedestals 21 (FIGS. 1–4), each pedestal 21 has a hollow box-like housing or enclosure 27 which preferably includes opposing spaced apart side walls 28. Each pedestal 21 also includes a plurality of vertically stacked drawers 29 which are slidably supported by the side walls 28. The drawers 29 are slidable into and out of the open front side of the housing 27.

Preferably, the lower two drawers 29 extend rearwardly into the housing 27 toward the back side thereof. The back ends of these lower drawers 29 are located close to the back wall of the housing 27 to maximize storage space.

However, to accommodate cabling in the area below the work surfaces 16, each pedestal 21 preferably includes a wire management well or compartment 31 which is located behind the uppermost drawer 29 which drawer 29 is shorter than the two lower drawers 29. The wire management well 31 is adapted to support various electrical and telecommunications components therein such as a conventional plug or outlet strip 32 to both protect and hide the electrical components. The plug strip 32 is of a conventional construction which is usable with telecommunications plugs or three prong electrical plugs 10*a*.

More particularly, the well 31 preferably has a rectangular shape which defines a hollow interior thereof. While the outermost end of the well 31 is completely enclosed by the outward facing side wall 28, the interior end of the well 31 opens into the open area 23 below the work surface 16. The interior end of the well 31 preferably includes an opening 33 formed through the inner pedestal wall 28. As a result, the cabling 10 can pass between the open leg area 23 and the wire management well 31. The opening 33 preferably is large enough to allow a user to be able to insert the plug strip 32 or other electrical components therethrough.

Accordingly, suitable power and telecommunications cabling 10 can be laid in the area beneath the work surfaces 16 and connected to the plug strip 32. While this cabling 10 can be laid on the floor, this cabling 10 preferably is suspended from the bottom surface of the work surface 16 using velcro straps 36 or other suitable fasteners. The velcro straps 36 are secured to the underside of the work surface 16 by double-sided tape, and then the opposite free ends of the velcro straps 36 are wrapped about the cabling 10 and fastened together.

While most of the cabling 10 is stored below the work surfaces 16 in the illustrated arrangement, it is desirable to pass the cabling 10 vertically through the work surfaces 16 to the top thereof where the office equipment 17 and 18 is located. Accordingly, each work surface 16 includes openings 39 (FIGS. 5 and 6) at the opposite ends thereof.

Each opening 39 has a generally rectangular shape and opens vertically between the top of the work surface 16 and the open area 23 located therebelow. Further, the opening 39 extends all of the way to the edge 40 of the work surface 16 so as to open sidewardly through the work surface edge 40 in the region directly above the top edge of the end wall 22 or the outer side walls 28 of the pedestals 21. When two desks 11 are positioned adjacent to each other as seen in FIG. 1, the openings 39 in the adjacent work surfaces 16 are disposed directly adjacent each other.

Figure 5:
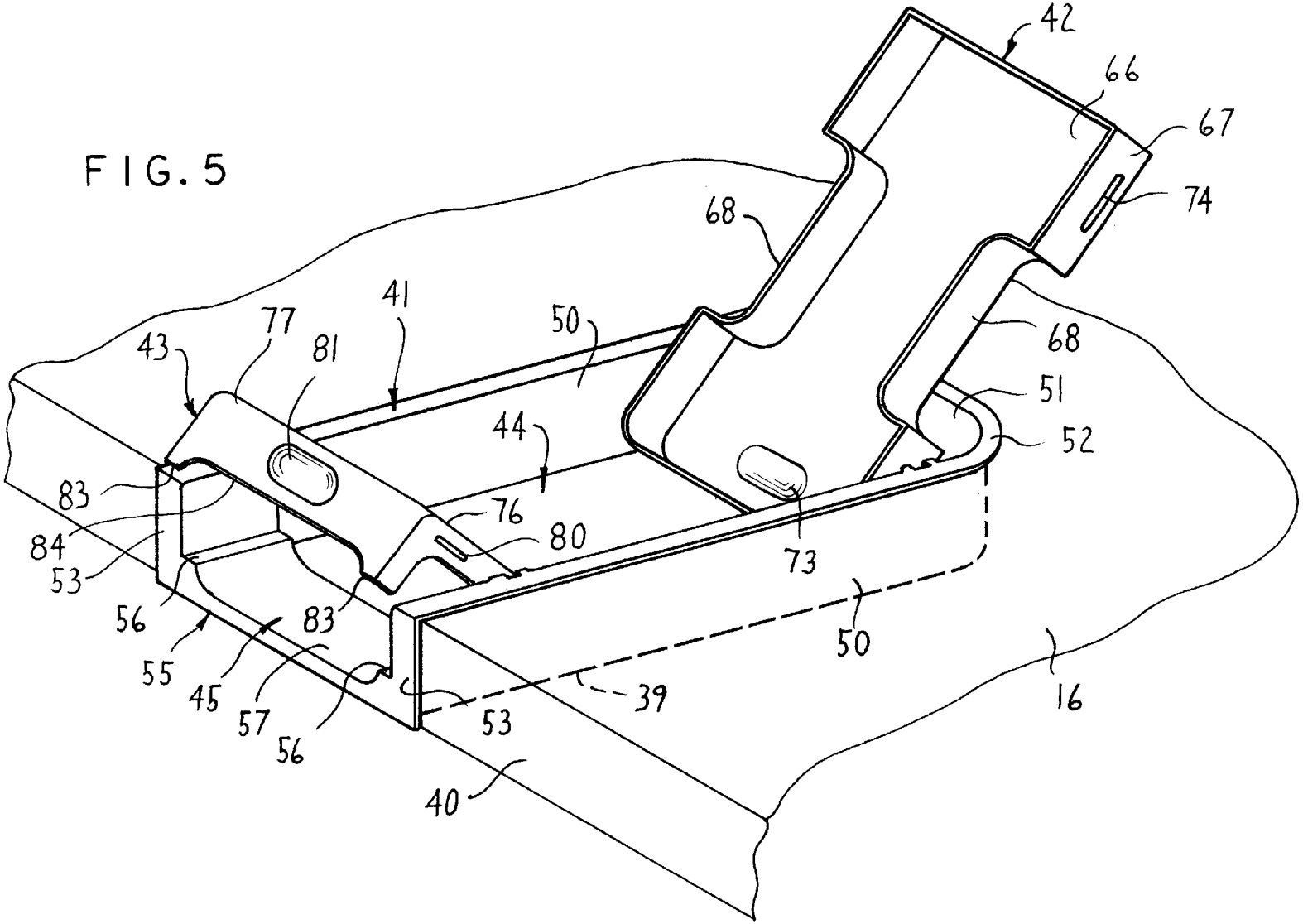
FIG. 5 is an enlarged isometric view of an edge grommet with top and end covers opened upwardly.
Figure 6:
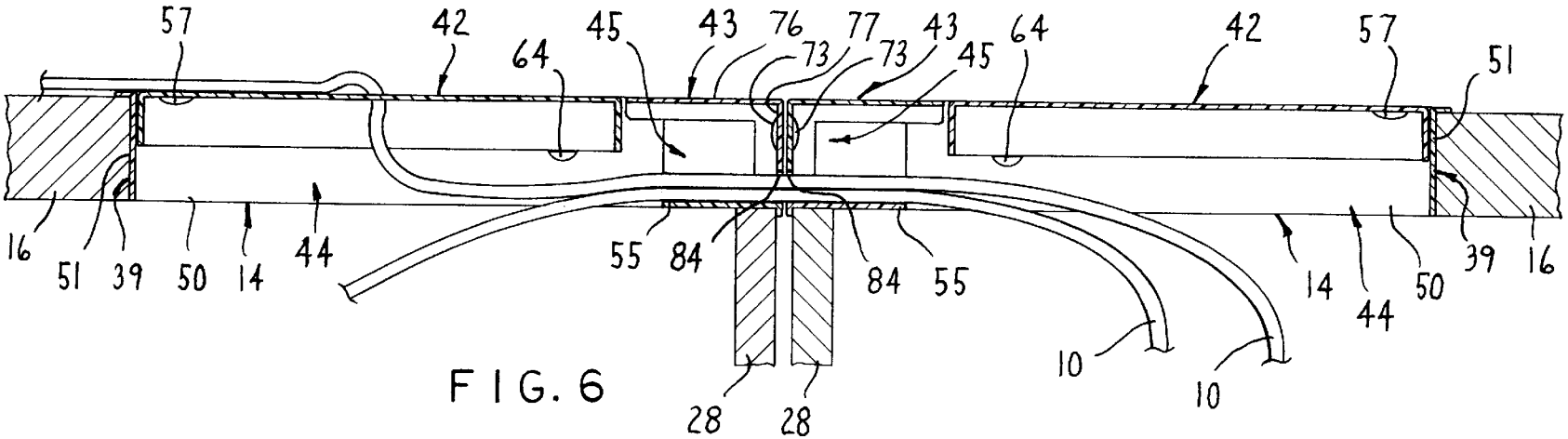
FIG. 6 is a partial cross sectional view of adjacent side edges of two desks as viewed in the direction of arrows 6—6 of FIG. 1.

Each opening 39 includes an end grommet 14 therein such that each of the desks 11 includes two end grommets 14 at the opposite ends thereof. Referring to FIGS. 5 and 6, the end grommets 14 include a ring-like housing 41, a top or inner cover 42 which is pivotally connected to the housing 41, and an end or outer cover 43 which also is pivotally connected to the housing 41. Preferably, these components of the end grommets 14 are formed of plastic or other suitable material.

The housing 41 generally defines a vertical passage 44 and a horizontal passage 45 which respectively permit the routing of cabling 10 vertically and horizontally through the work surface 16. The vertical passage 44 and horizontal passage 45, however, are normally closed by the top and end covers 42 and 43 which also are openable as seen in FIG. 5 to permit the laying in of the cabling 10.

More particularly with respect to the housing 41 (FIGS. 6–8), the housing 41 includes upstanding spaced apart side walls 50 and an end wall 51 which define the three interior sides of the housing 41 and are dimensioned so as to seat in the opening 39.

To support the housing 41 in the opening 39, the side walls 50 and end wall 51 include a horizontal lip or flange 52 which projects outwardly from the top edges thereof. The outermost vertical edges of the side walls 50 further include vertical lips or flanges 53 which project outwardly so as to abut against the edge 40 of the work surface 16. Accordingly, when the housing 41 is seated within the work surface opening 39 as seen in FIGS. 5 and 6, the horizontal lip 52 is seated on the top of the work surface 16, and the vertical lips 53 abut against the edge 40.

The housing 41, however, is open near the work surface edge 40 on the outer side thereof opposite the end wall 51. While the top of the housing 41 also is open, the bottom of the housing 41 is partially enclosed by a bottom wall 55 which extends horizontally between the bottom edges of the side walls 50. The bottom wall 55 extends inwardly away from the open end of the housing 41 a limited distance so that at least a portion of the bottom of the housing 41 is open. The bottom wall 55 preferably is disposed directly above the top edge of the outer pedestal wall 28.

To accommodate the cabling 10 as it extends through the horizontal passage 45, the bottom wall 55 includes steps or support surfaces 56 near the side walls 50. The bottom wall 55 also includes an upward opening recess or notch 57 disposed between the support surfaces 56.

More particularly, with respect to the horizontal passage 45, the area of the open end of the housing 41 located above the bottom wall 55 generally defines the horizontal passage 45. Thus, the bottom wall 55 as well as the portions of the side walls 50 which project upwardly therefrom define three sides of the horizontal passage 45.

The horizontal passage 45, however, opens sidewardly through the work surface edge 40. Since the height of the horizontal passage 45 generally corresponds to the height of the worksurface 16 as seen in FIG. 6, it is not necessary to notch out or cut the top edge of the pedestal side wall 28 or desk end wall 22.

The horizontal passage 45 extends inwardly away from the open end so as to be in communication with the vertical passage 44 which extends vertically through the housing 41. In particular, the vertical passage 44 extends vertically between the open portion of the bottom of the housing 41 and the open top thereof.

As a result, the cabling 10 (FIG. 6) can be inserted through the vertical passage 44 so as to extend vertically through the entire work surface 16 between the floor level and work surface level. Alternatively, the cabling 10 can be inserted upwardly or downwardly into the vertical passage 44 and bent so as to extend sidewardly through the horizontal passage 45.

When two desks 11 are disposed adjacent to each other, the adjacent horizontal passages 45 communicate with each other. Accordingly, the cabling 10 can be laid into and along two adjacent horizontal passages 45 as shown in FIG. 6 so as to extend continuously from one desk 11 into an adjacent desk 11. While the horizontal passages 45 typically are used to extend the cabling 10 between two desks 11, the horizontal passage 45 also can be used for egress of cabling 10 out of one of the desks 11 if an adjacent desk 11 is not provided.

Referring to FIGS. 5–8, the vertical and horizontal passages 44 and 45 are relatively large so as to provide full access to the wire management well 31 and make it easier to lay cabling through these passages. However, the top and end covers 42 and 43 are provided so that most of the vertical and horizontal passages 44 and 45 are enclosed during use.

To pivotally connect the top cover 42 and end cover 43 to the housing 41, the housing side walls 50 are formed with an inner pair of pin seats 58 for the top cover 42 and an outer pair of pin seats 59 for the end cover 43.

Figure 9:
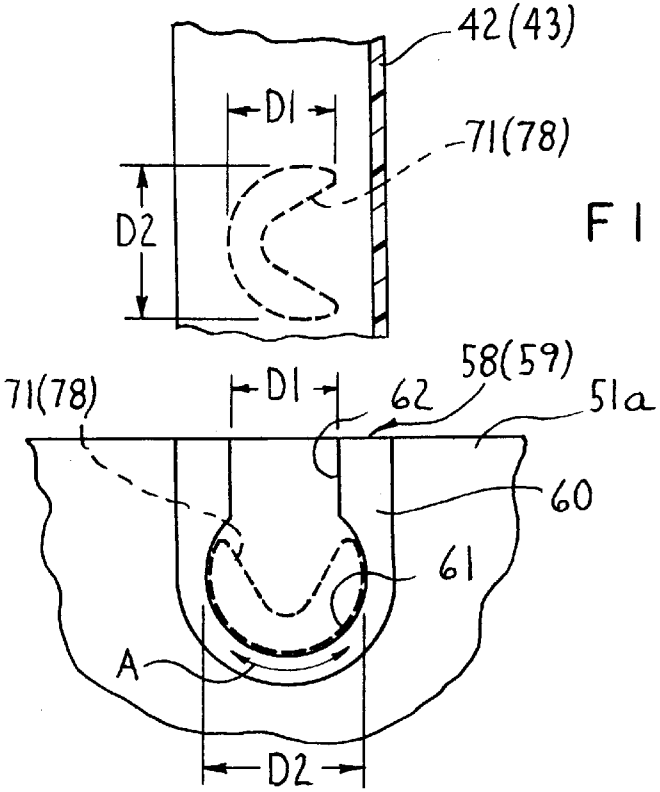
FIG. 9 is a partial view of the pivot arrangement connecting the top and end covers to a grommet housing.

Referring to FIG. 9, one of the inner pin seats 58 is illustrated prior to the connection of the top cap 42 thereto. The inner pin seat 58 is formed from a U-shaped wall 60 which projects from the interior surface of the respective housing side wall 50. The wall 60 opens both upwardly from a top end as well as inwardly from one side into the vertical passage 44.

The wall 60 defines a semi-circular enlarged bearing section 61 on the lower end thereof, while the upper portion of the wall 60 defines a straight or vertical entry channel 62. The entry channel 62 preferably has a width which is smaller than the bearing area 61 as seen in FIG. 9. While one of the inner pivot seats 58 is illustrated in FIG. 9, the outer pivot seats 59 are formed substantially identical to the inner pin seat 58.

To support the swinging free end of the top cover 42, the housing walls 50 also are formed with upward facing projections or ledges 64 (FIGS. 6 and 7) which are located proximate to but are spaced inwardly from the outer pin seats 59.

With respect to the top cover 42 (FIGS. 5–8), the top cover 42 has a generally rectangular shape which corresponds to the size of the vertical passage 44. The top cover 42 overlies the upper end of this vertical passage, and includes a top wall 66 as well as a peripheral side wall 67.

Preferably the top wall 66 and side wall 67 define cable notches or openings 68 on the opposite side edges thereof. The cable notches 68 permit or accommodate the routing of the cabling 10 vertically through the top cover 42 when in the closed position. Preferably these notches 68 are dimensioned so as to accommodate several individual cables 10 which may be routed therethrough while at the same time being sufficiently small so as to restrict access to the vertical passage 44.

To support the top cover 42 on the housing 41, the innermost ends of the top cover 42 are formed with pivot pins 71 which project from the opposite sides of the side wall 67 and are adapted to seat within the inner pin seats 58 of the housing 41. As seen in FIG. 9, the pivot pins 71 are formed by a generally U-shaped semi-circular projection which projects outwardly from the side wall 67.

More particularly, the pivot pins 71 effectively are defined by a cylindrical projection which has a portion removed. Thus, each pivot pin 71 has a maximum width or diameter D1 along a major axis thereof which is greater than a narrower width D2 measured transverse thereto along a minor axis. When the top wall 66 is positioned in a substantially vertical orientation as generally illustrated in FIG. 9, the narrow width D2 is adapted to fit through the narrow slot or channel 62 of the inner pin seat 58. The pivot pin 71 is inserted downwardly into the bearing section 61 when the top cover 42 is oriented generally vertically.

The diameter of the bearing area 61, however, is larger than the channel 62 and corresponds to the wide diameter or width D1 of the pin 71 such that pivoting of the pin 71 is permitted as generally indicated by arrow A in FIG. 9.

Figure 7:
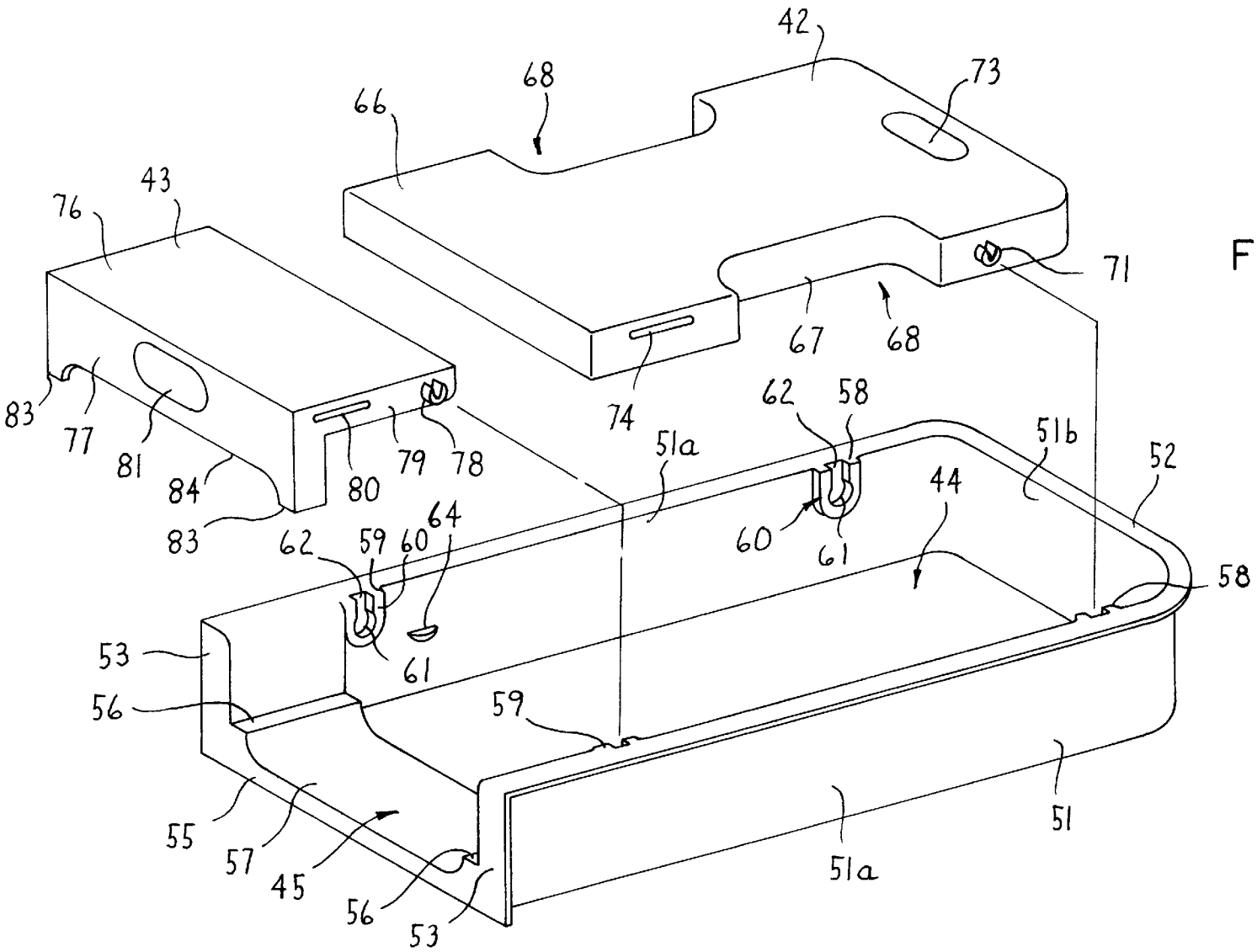
FIG. 7 is an exploded isometric view of the end grommet.
Figure 8:
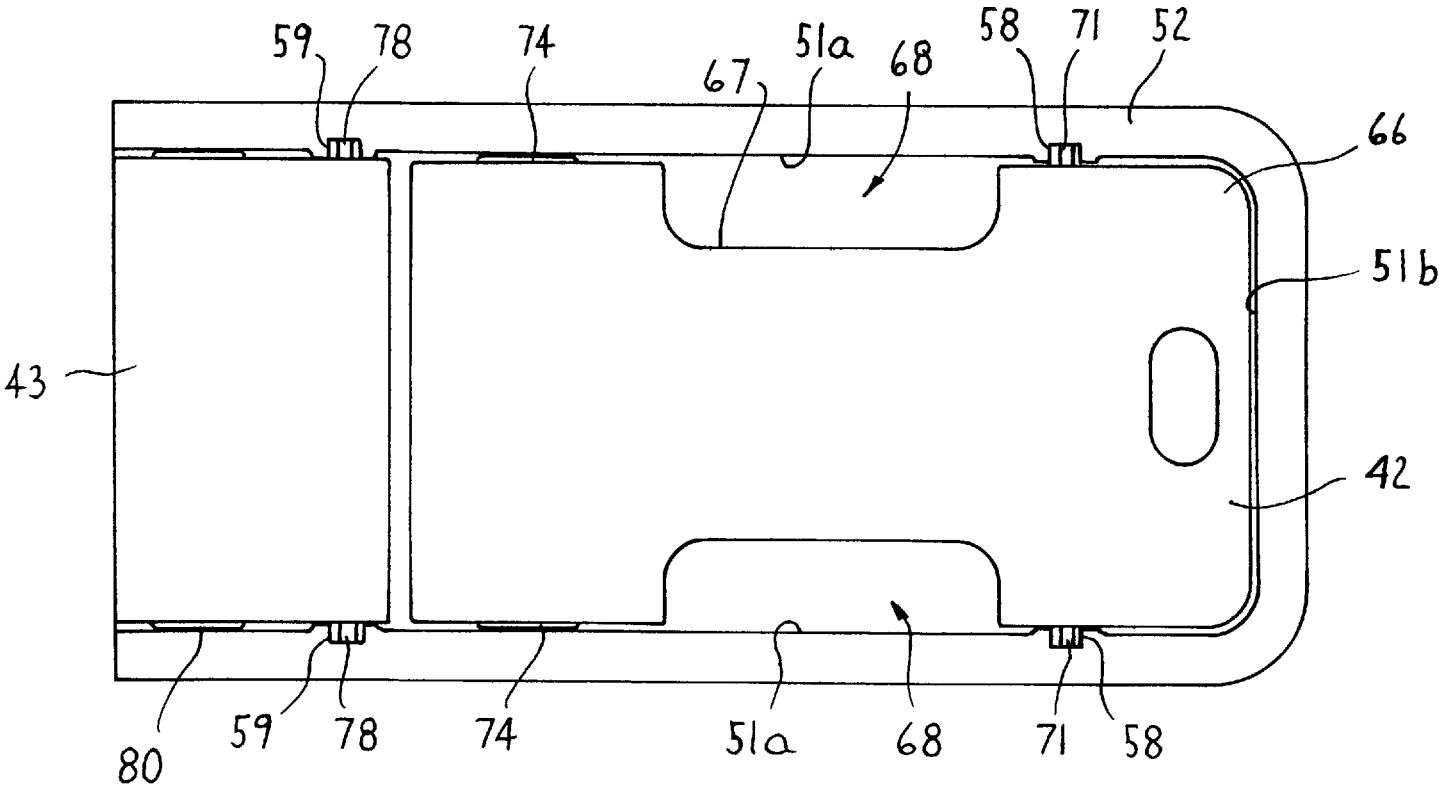
FIG. 8 is a top plan view of the end grommet.

Once the pivot pins 71 have been inserted into the inner pin seat 58, the top cover 42 can be pivoted downwardly from the generally vertical open position as indicated by FIGS. 5 and 7 to the horizontal closed position illustrated in FIG. 8. The closed position of the top cover 42 also is diagrammatically illustrated in FIG. 9 wherein the pivot pin 71 is fully seated and rotated within the bearing seat 61 as seen in phantom outline.

Once the pivot pin 71 has been rotated, the larger width D1 thereof prevents the top cover 42 from being slid out of the vertical channel 62. However, upon upward rotation of the top cover 42 to the vertical position, the narrower width D2 is again positioned for sliding of the pivot pin 71 vertically out of the channel 62.

The pivot pin 71 and inner pin seat 58 thereby provide for pivoting engagement of the top cover 42 to the housing 41 while at the same time preventing inadvertent removal of the top cover 42.

To assist in pivoting of the top cover 42 upwardly from the horizontal position, a concave finger recess 73 (FIGS. 6–8) is formed on the innermost end of the top cover 42. The finger recess 73 can be pressed downwardly to pivot the opposite free end of the top cover 42 upwardly.

The outer free end of the top cover 42 also rests on the projections 64 formed in the housing wall 51. The top cover 42 further includes ribs 74 on the opposite sides thereof which provide for a frictional sliding of the free end of the top cover 42 into the housing 41. The ribs 74 positively retain the top cover 42 in the closed position.

More particularly with respect to the outer or end cover 43, the end cover 43 has a generally L-shaped cross-section which is defined by a horizontal wall 76 and a downwardly depending vertical wall 77. The horizontal wall 76 effectively overlies the horizontal passage 45 and is pivotally connected to the housing 41 by pivot pins 78 which project sidewardly from a side wall 79 thereof. When the end cover 43 is in the closed position, the vertical wall 77 encloses the open outer end of the horizontal passage 45.

More particularly, the pivot pins 78 are formed substantially identical to the pivot pins 71 in that they are slidable into the outer pin seats 59 when the end cover 43 is oriented vertically. The connection of the end cover 43 to the housing 51 is the same as the connection of the top cover 42 since the pivot pins 71 and 78 and inner and outer pin seats 58 and 59 are functionally and structurally the same. Rotation of the end cover 43 downwardly thereby secures the pivot pins 78 into the bearing section 61 of the outer pin seats 59.

The end cover 43 also includes ribs 80 on the opposite sides thereof. The ribs 80 provide for a frictional engagement of the end cover 43 with the housing 41 as described above with respect to the ribs 74. Also, a concave finger recess 81 is provided to allow a user to lift the end of the end cover 43 upwardly.

To allow for the horizontal routing of the cabling 10 through the horizontal passage 45, the vertical wall 77 also is formed with downwardly extending leg-like sections 83 which rest on the support surfaces 56 of the bottom wall 55. While the vertical wall 77 closes off most of the end of the horizontal passage 45, the bottom edge of the vertical wall 77 includes a downwardly and sidewardly opening notch 84 which aligns with the corresponding recess 57 formed in the bottom wall 55 of the housing 41. When the end cover 43 is rotated downwardly to the closed position as illustrated in FIGS. 6 and 8, the notch 84 is vertically aligned with the recess 57 to define a horizontal opening through which the individual cables 10 can pass.

As a result, each end grommet assembly 14 accommodates horizontal and vertical routing of cabling into and out of the desk 11, or to and from the top of the work surface 16. Further, when aligned with an additional end grommet assembly 14 of an adjacent desk 11, the cabling 10 can be routed between the desks 11 while being hidden and protected from damage.

Figure 10:
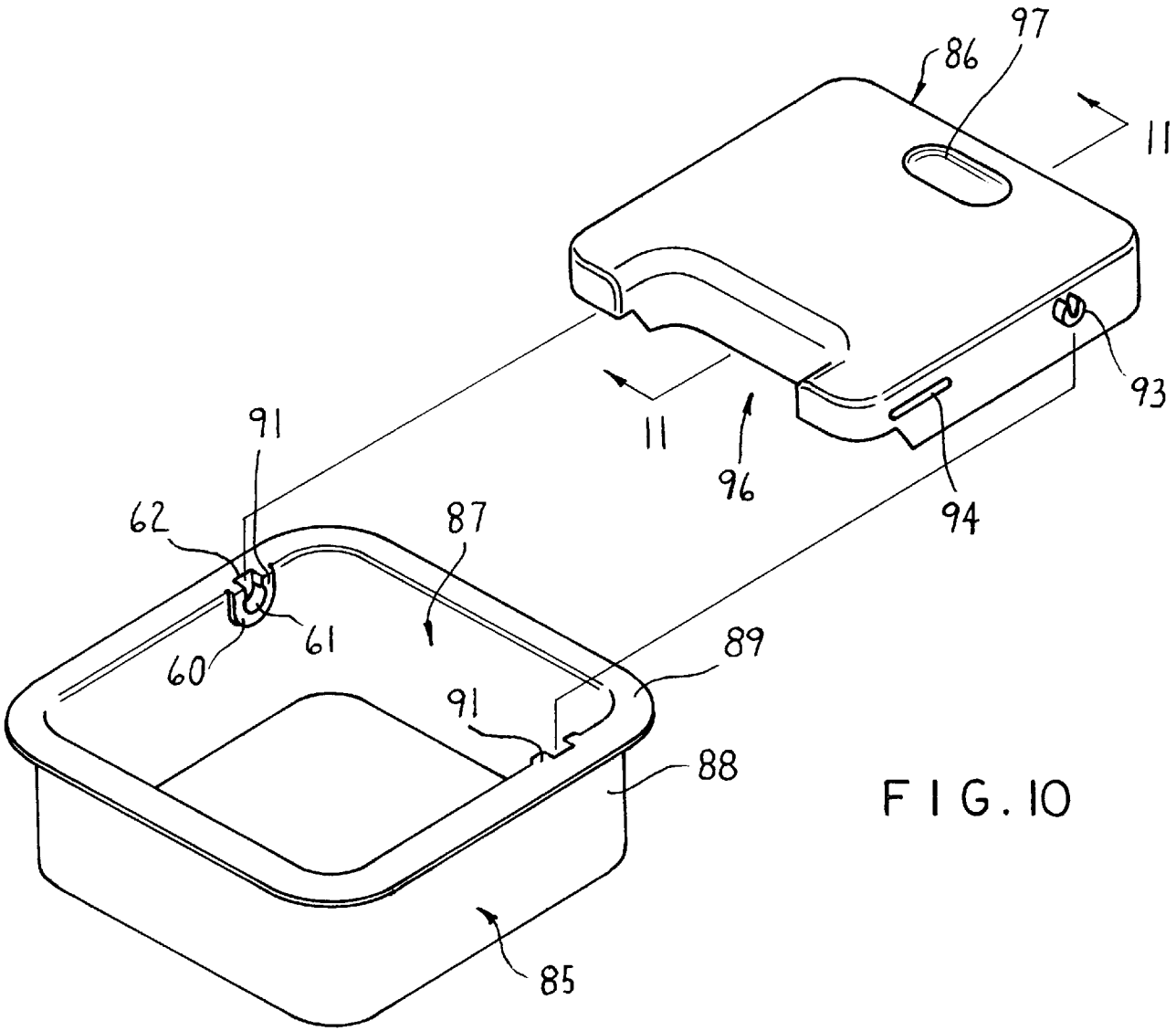
FIG. 10 is an exploded isometric view of a secondary grommet.

While the end grommet assemblies 14 can provide the necessary capacity to route cabling both vertically and horizontally through the desks 11, it may also be necessary or desirable to provide additional vertical passages through the work surfaces 16. Accordingly, one or more secondary grommet assemblies 15 can be provided, such as the secondary grommet assembly 15 which is provided in the return desk 11' as illustrated in FIG. 1. Referring to FIG. 10, the secondary grommet 15 includes a rectangular housing 85 which defines a vertical passage 87 therethrough, and a pivotable top cap 86 which is connected to the housing 85.

The housing 85 is formed from an annular side wall 88 which includes an outwardly projecting flange 89 along the top edge thereof. The flange 89 is adapted to be pressed onto the top of the work surface 16 when the housing 85 is mounted in a rectangular opening formed in the work surface 16'.

The housing 85 further includes a pair of pin seats 91 which are formed identical to the pin seats 58 and 59 described previously. Two of the interior corners of the housing 85 also include an outwardly projecting L-shaped rib 92 which defines a support surface for the top cap 86.

The top cap 86 has a rectangular shape which is adapted to overlie most of the vertical passage 87. The top cap 86 includes a pair of pivot pins 93 which project from the opposite sides thereof and are adapted to be engaged with the pin seats 91. In particular, the pins 93 are engaged with and rotate relative to the pin seats 91 in the same structural and functional arrangement as described above with respect to the pin seats 58 and 59 and the corresponding pins 71 and 78. Accordingly, a more detailed discussion with respect to the pin seats 91 and pins 93 is not necessary since the foregoing discussion is equally applicable hereto.

Figure 11:
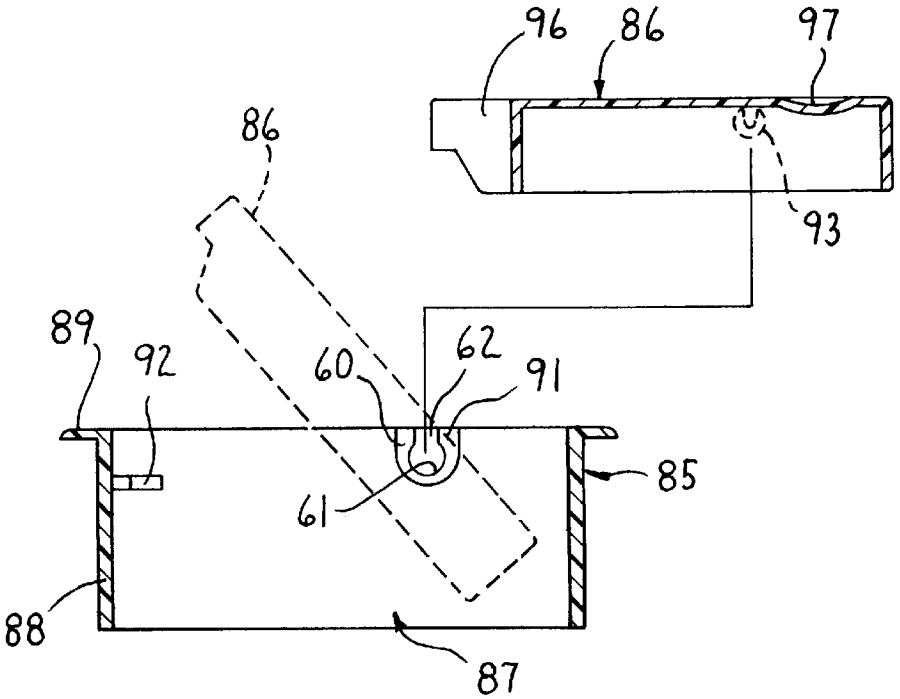
FIG. 11 is a cross sectional view in cross-section of the secondary grommet as viewed in the direction of arrows 11—11 of FIG. 10.

The top cap 86 also includes a pair of ribs 94 which frictionally engage the interior surface of the housing side wall 88 so as to positively maintain the top cap 86 in the closed position. The top cap 86 further includes a notch or recess 96 on the free pivoting end thereof. The notch 96 permits the passage of the cabling 10 therethrough. However, the top cap 86 also can be pivoted upwardly to the open position generally illustrated in phantom outline in FIG. 11 to allow a user to move or rearrange the cabling 10. The top cap 86 also includes a concave finger recess 97 which is located on the side of the pivot pin 93 opposite the notch 96 so as to permit opening of the top cap 86.

With this wire management arrangement which includes the end grommet assemblies 14 and the secondary grommet assembly 15, a user can readily route cabling 10 throughout an office area.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A grommet for managing cables comprising:

a housing having a pair of spaced apart housing side walls and an open end at one end of said side walls which opens sidewardly in an outward direction, said housing further including a bottom wall which extends between said side walls adjacent said open end, said bottom wall extending inwardly away from said open end to enclose a portion of the bottom of said housing, said housing having an open interior which defines a vertical passage extending through said housing and a horizontal passage disposed above said bottom wall that extends inwardly from said open end and is in communication with said vertical passage;

a horizontally enlarged top cover which includes first pivot means for pivotally connecting said top cover to said housing, said first pivot means defining a first pivot axis which extends sidewardly between said housing side walls such that said top cover is pivotable between a closed position and an open position, said top cover overlying said vertical passage when in said closed position and projecting upwardly so as to provide access to said vertical passage when in said open position, said top cover including at least one notch in an edge thereof which opens vertically through said top cover to permit the passage of cabling through said notch and said vertical passage when said top cover is in said closed position; and an end cover disposed adjacent to said open end which has an L-shaped cross-section defined by a horizontal section and a vertical section depending downwardly from said horizontal section, said end cover including second pivot means for pivotally connecting said end cover to said housing such that said end cover is pivotable between a closed position and an open position about a second horizontal pivot axis extending sidewardly between said housing side walls, said horizontal section overlying said bottom wall of said housing so as to enclose a top of said horizontal passage when said end cover is in said closed position, said vertical section extending downwardly so as to substantially enclose said open end of said housing when in said closed position and including at least one notch in an edge thereof which opens horizontally between said horizontal passage and an exterior of said grommet.

2. A grommet according to claim 1, wherein said top cover is pivotally connected to said housing by said pivot means proximate an inner end thereof, said top cover having a free end extending away from said pivot means towards said open end of said housing wherein said free end is swingable upwardly to said open position.

3. A grommet according to claim 1, wherein said notch in said end cover opens downwardly through a lower edge of said vertical section toward said bottom wall so as to allow cabling to be laid therethrough without being disturbed when said end cover is pivoted to said open position.

4. The grommet according to claim 3, wherein said bottom wall includes an upward opening recess which communicates with said notch of said end cover to accommodate cabling therein.

5. A grommet according to claim 1, wherein each of said end cover and said top cover includes cover side walls on the opposite sides thereof which are disposed in opposing relation with interior housing surfaces defined by said housing side walls, each of said first and second pivot means comprising pins projecting sidewardly from one of said interior housing surfaces and said cover side walls and respective pin seats formed in the other of said interior housing surfaces and said cover side walls.

6. A grommet according to claim 5, wherein said pin has a non-uniform cross-sectional shape which defines a wide width in a first direction and a narrow width in a second direction transverse to said first direction, each of said pin seats adapted to receive one of said pins therein, each of said pin seats comprising an entry channel which has a width corresponding to said narrow width of said pin and a pivot section in communication with said entry channel which has a width corresponding to said wide width of said pin, said pin being slidable in an entry direction through said entry channel and into said pivot section when said narrow width is oriented transverse to said entry direction, said pin being pivotable when seated in said pivot section.

7. A grommet according to claim 6, wherein said pin is insertable downwardly into said entry channel only when said top or end cover is in said open position, said wide width of said pin being oriented transverse to said entry direction when said top or end cover is in said closed position such that said wide width of said pin prevents said pin from sliding upwardly through said entry channel.

8. A grommet according to claim 1, wherein said first and second pivot means are each disengagable from said housing so as to permit disengagement of said top cover or said end cover from said housing when in one of said open and closed positions thereof, said first and second pivot means preventing disengagement of said top and end covers from said housing when in the other of said open and closed positions.

9. In a furniture arrangement having at least one horizontally enlarged work surface having opposite end edges, said furniture arrangement including a wire management arrangement therein comprising the improvement wherein each of said end edges includes a work surface notch which opens horizontally through said end edge and opens vertically through said work surface, each of said work surface notches including an end grommet fitted therein for managing the passage of cabling vertically through said work surface and horizontally through said end edge, each said end grommet including a housing which is seated in a respective one of said notches and defines a vertical passage therethrough and a horizontal passage which extends outwardly between said vertical passage and an open end of said housing disposed adjacent said end edge, each of said end grommets including a horizontally enlarged top cover and an L-shaped end cover, said top cover including pivot means for pivotally connecting said top cover to said housing such that said top cover is pivotable between open and closed positions, said top cover enclosing said vertical passage when in said closed position and including a notch formed in an edge thereof to permit the passage of cabling therethrough when in said closed position, said end cover being defined by a horizontal cover section and a vertical cover section depending downwardly therefrom, said horizontal cover section including second pivot means for pivotally connecting said end cover to said housing so as to be pivotable between open and closed positions, said horizontal cover section enclosing said horizontal passage and said vertical cover section enclosing said open end when in said closed position, said end cover including at least one end notch formed in an edge thereof which permits the passage of cabling horizontally through said open end of said end grommet when in said closed position.

10. A wire management arrangement according to claim 9, wherein said work surface includes a bottom surface which is supported on a top edge of a work surface support wall, said open end of said housing being disposed above said support wall.

11. A wire management arrangement according to claim 10, wherein said housing includes a bottom wall disposed adjacent said open end, said bottom wall extending inwardly away from said open end to enclose a portion of said work surface notch, said bottom wall being spaced downwardly from said horizontal cover section of said end cover when in said closed position so as to define said horizontal passage therebetween.

12. A wire management arrangement according to claim 11, wherein said bottom wall is disposed directly above said top edge of said support wall.

13. A wire management arrangement according to claim 9, wherein said open end of said housing is defined vertically between top and bottom surfaces of said work surface so as to be disposed above said work surface support wall.

14. A wire management arrangement according to claim 9, wherein another worksurface is disposed adjacent said work surface and includes additional said end grommets in the opposite ends thereof, one of said additional end grommets being disposed directly adjacent one of said end grommets in said work surface such that said open ends thereof are in communication one with the other.

15. A wire management arrangement according to claim 9, wherein said work surface includes a hollow compartment disposed below at least one of said end grommets, said vertical passage extending between a top surface of said work surface and a hollow interior of said compartment, said compartment having an enclosed outer side thereof and having an open inner side which opens inwardly into an area disposed below said work surface.

16. A grommet for managing cables comprising:

a housing having a pair of spaced apart housing side walls and a hollow interior between said housing side walls which defines a passage extending through said housing, said passage having first and second open ends which open from said housing so as to receive cabling therethrough, said passage extending horizontally through said housing and said first open end thereof opening sidewardly through an open end of said housing, and a cover which includes pivot means for pivotally connecting said cover to said housing such that said cover overlies said first open end of said passage, said pivot means defining a pivot axis which extends sidewardly between said housing side walls such that said cover is pivotable between a closed position and an open position, said cover having an L-shaped cross-section defined by a horizontal section which overlies an upper side of said horizontal passage and a vertical section extending downwardly from said horizontal section so as to enclose said open end of said housing, said cover including at least one notch in an edge thereof which opens through said cover to permit the passage of cabling therethrough when said cover is in said closed position, said pivot means comprising pins protecting sidewardly from one of said cover and said housing side walls and respective pin seats formed in the other of said cover and said housing side walls, each of said pins having a non-circular cross-sectional shape which defines a wide width along a major axis thereof and a narrow width along a minor axis thereof oriented transverse to said major axis, each of said pin seats comprising an entry channel which has a narrow width corresponding to said narrow width of said pin and a pivot section in communication with said entry channel which has a wide width corresponding to said wide width of said pin, said pin being slidable in an entry direction through said entry channel and into said pivot section when said narrow width of said pins is oriented transverse to said entry direction, said pin being pivotable when seated in said pivot section.

17. A grommet according to claim 16, wherein said pin is insertable into said entry channel only when said cover is in said open position, said wide width of said pin being oriented transverse to said entry direction when said cover is in said closed position such that said wide width of said pin prevents said pin from sliding through said entry channel.

18. A grommet according to claim 17, wherein said entry channel opens upwardly and said pin is insertable downwardly into said entry channel toward said pivot section.

19. A grommet according to claim 17 wherein said passage extends vertically through said housing between said first open end which defines an upper end of said vertical passage and said second open end which defines a lower end of said vertical passage, said cover overlying said upper end when in said closed position.

20. In a furniture arrangement having a work surface and a wire management arrangement comprising the improvement wherein an edge of said work surface includes a wire passage which opens horizontally through said edge and vertically through said work surface, said wire passage including a grommet disposed therein for managing the passage of cabling vertically through said work surface and horizontally through said edge, said grommet including a housing which is seated in said wire passage and defines a vertical passage therethrough and a horizontal passage which opens through an open end of said housing, said open end being disposed proximate said edge of said work surface, said grommet further including a horizontally enlarged top cover and an end cover, said top cover including first pivot means for pivotally connecting said top cover to said housing such that said top cover is pivotable between open and closed positions, said top cover enclosing said vertical passage when in said closed position and defining an opening to permit the passage of cabling therethrough when in said closed position, said end cover including a horizontal section and a vertical section connected to said horizontal section, said horizontal section including second pivot means for pivotally connecting said end cover to said housing so as to be pivotable between open and closed positions, and said vertical section enclosing said open end when said end cover is in said closed position and being displaceable upwardly away from said open end during pivoting of said end cover about said second pivot means, said vertical section defining an opening which permits the passage of cabling horizontally through said open end of said grommet when in said closed position.

21. A wire management arrangement according to claim 20, wherein said horizontal section extends horizontally between said vertical section and said second pivot means and overlies said horizontal passage when said end cover is in said closed position.

22. A wire management arrangement according to claim 20, wherein said first pivot means is disposed between opposite ends of said top cover such that manual pressing of one of said opposite ends pivots the other opposite end upwardly to said open position.

23. A wire management arrangement according to claim 20, wherein said end cover and said top cover are removable when in said open position to provide access to said vertical passage and said horizontal passage.

24. A grommet for managing cables comprising:

a housing having a hollow interior which receives cabling therein and defines a horizontal passage extending through an open end of said housing; and a cover which includes pivot means for pivotally connecting said cover to said housing so as to overlie said open end of said passage, said pivot means defining a pivot axis which extends sidewardly between opposite side walls of said housing such that said cover is pivotable between a closed position and an open position, said pivot means preventing removal of said cover when in said closed position while permitting removal of said cover from said housing when said cover is in said open position, said cover overlying said open end of said passage when in said closed position and projecting upwardly so as to provide access to said passage when in said open position, said cover having an L-shaped cross-section defined by a horizontal section which overlies an upper side of said horizontal passage and a vertical section extending downwardly from said horizontal section so as to enclose said open end of said housing, said vertical section defining an opening on an edge thereof to permit the passage of cabling horizontally therethrough when said cover is in said closed position.

25. A grommet according to claim 24, wherein said housing defines a vertical passage which extends into said hollow interior and is in communication with said horizontal passage.

26. A grommet according to claim 25, wherein said grommet includes a top cover which is pivotally connected to said housing and overlies said vertical passage.

27. A grommet according to claim 24, wherein a lower edge of said vertical section defines said opening for the passage of cabling.

* * * * *

UNITED STATES PATENT AND TRADEMARK OFFICE

CERTIFICATE OF CORRECTION

PATENT NO. : 5 860 713

DATED : January 19, 1999

INVENTOR(S) : Earl Richardson

It is certified that error appears in the above-identified patent and that said Letters Patent is hereby corrected as shown below:

Column 12, line 20;

change "protecting" to ---projecting---.

Column 12, line 46;

after "claim 17" insert ---,---.

Signed and Sealed this

Fourteenth Day of September, 1999

*Attest:*

Q. TODD DICKINSON

*Attesting Officer*

*Acting Commissioner of Patents and Trademarks*